US008558754B2

(12) United States Patent
Drake et al.

(10) Patent No.: US 8,558,754 B2
(45) Date of Patent: Oct. 15, 2013

(54) ANTENNA AND A METHOD OF MANUFACTURING AN ANTENNA

(75) Inventors: Jenny Sarah Drake, Quorn (GB); Oliver Paul Leisten, Northamptonshire (GB)

(73) Assignee: Sarantel Limited, Wellingborough (GB)

( * ) Notice: Subject to any disclaimer, the term of this patent is extended or adjusted under 35 U.S.C. 154(b) by 485 days.

(21) Appl. No.: 12/545,440

(22) Filed: Aug. 21, 2009

(65) Prior Publication Data

US 2010/0045562 A1 Feb. 25, 2010

Related U.S. Application Data

(60) Provisional application No. 61/097,774, filed on Sep. 17, 2008.

(30) Foreign Application Priority Data

Aug. 21, 2008 (GB) ..... 0815306.6

(51) Int. Cl.
*H01Q 1/36* (2006.01)

(52) U.S. Cl.
USPC ..... 343/895; 343/905

(58) Field of Classification Search
USPC ..... 343/895, 905
See application file for complete search history.

(56) References Cited

U.S. PATENT DOCUMENTS

| | | | | |
|---|---|---|---|---|
| 6,024,584 | A * | 2/2000 | Lemke et al. | 439/83 |
| 6,914,566 | B2 * | 7/2005 | Beard | 343/702 |
| 7,256,752 | B2 * | 8/2007 | Wither et al. | 343/905 |
| 2007/0063918 | A1 * | 3/2007 | Leisten et al. | 343/895 |
| 2007/0187809 | A1 | 8/2007 | Khorram | |
| 2008/0174512 | A1 | 7/2008 | Leisten | |

FOREIGN PATENT DOCUMENTS

| | | |
|---|---|---|
| EP | 1126522 | 8/2001 |
| EP | 0917241 | 6/2002 |
| EP | 1076378 | 7/2008 |
| GB | 2292638 | 2/1996 |
| GB | 2309592 | 7/1997 |
| GB | 2310543 | 8/1997 |
| GB | 2399948 | 6/2006 |
| GB | 2441566 | 3/2008 |
| GB | 2445478 | 7/2008 |
| WO | 02/103750 | 12/2002 |
| WO | 2006136809 | 12/2006 |

* cited by examiner

*Primary Examiner* — Hoang V Nguyen
*Assistant Examiner* — Kyana R McCain
(74) *Attorney, Agent, or Firm* — Byrne Poh LLP

(57) ABSTRACT

A dielectrically-loaded antenna has a cylindrical ceramic core, a three dimensional antenna element structure comprising co-extensive helical conductors plated on a cylindrical side surface of the core and a dielectrically-loaded antenna has a solid cylindrical core made of a ceramic material, helical antenna elements made of a ceramic material, co-extensive helical antenna elements plated on the core, connecting conductors on a distal end surface, a matching section in the form of a printed circuit board overlying the core distal end surface and a coaxial feeder housed in an axial bore passing through the core. For ease of manufacture, the laminate board of the matching section contains a ball grid array having a plurality of solder elements which serve to connect the matching network to both the surface connection elements on the distal core end surface and to the feeder. At a proximal end of the feeder there is a transversely extending flange for connecting the shield of the feeder to a plating on a proximal end surface of the core, the plating forming part of an integral balun.

13 Claims, 7 Drawing Sheets

ANTENNA AND A METHOD OF MANUFACTURING AN ANTENNA

The present application claims priority to British Patent Application No. 0815306.6, filed Aug. 21, 2008, and to U.S. Provisional Patent Application No. 61/097,774, filed Sep. 17, 2008. The entirety of each application is incorporated by reference herein.

BACKGROUND

Example embodiments of the present invention relate to a dielectrically-loaded antenna for operation at a frequency in excess of 200 MHz and having an electrically insulative core of a solid material, and to a method of manufacturing such an antenna.

It is known to dielectrically load helical antennas for operation at UHF frequencies, particularly compact antennas for portable devices such as cellphones, satellite telephones and handheld or mobile positioning units. Typically, such an antenna includes a cylindrical ceramic core having a relative dielectric constant of at least 5, the outer surface of the core bearing an antenna element structure in the form of helical conductive tracks. In the case of a so-called "backfire" antenna, an axial feeder is housed in a bore extending through the core between proximal and distal transverse outer surface portions of the core, conductors of the feeder being coupled to the helical tracks via conductive surface connection elements on the distal transverse surface portion of the core. Such antennas are generally described in Published British Patent Applications Nos. GB2292638, GB2309592, GB2399948, GB2441566, GB2445478, International Application No. WO2006/136809 and U.S. Published Application No. 2008/0174512. These published documents generally describe antennas having one, two, three or four pairs of helical antenna elements or groups of helical antenna elements. WO2006/136809, GB2441566, GB2445478 and US2008-0174512A1 each generally describe an antenna with an impedance matching network including a printed circuit laminate board secured to the distal outer surface portion of the core, the network forming part of the coupling between the feeder and the helical elements. The above published applications, in their entirety, are incorporated herein by reference. In each antenna described in the above applications, the feeder is a coaxial transmission line, the outer shield conductor of which has connection tabs extending parallel to the axis through vias in the laminate board, the inner conductor similarly extending through a respective via. The antenna is assembled by, firstly, inserting the distal end portions of the coaxial feeder into the vias in the laminate board to form a unitary feeder structure, inserting the feeder, with the laminate board attached, into the passage in the core from the distal end of the passage so that the feeder emerges at the proximal end of the passage and the laminate board abuts the distal outer surface portion of the core. Next, a solder-coated washer or ferrule is placed around the proximal end portion of the feeder to form an annular bridge between the outer conductor of the feeder and a conductive coating on the proximal outer surface portion of the core. This assembly is then passed through an oven whereupon solder paste previously applied at predetermined locations on the proximal and distal faces of the laminate board, as well as the solder on the above-mentioned washer or ferrule, melts to form connections (a) between the feeder and the matching network, (b) between the matching network and the surface connection elements on the distal outer surface portion of the core, and (c) between the feeder and the conductive layer on the proximal outer surface portion of the core. Assembly and securing of the feeder structure of the core is, therefore, a three-step process, i.e., insertion, placing of the washer or ferrule, and heating. It is an object of example embodiments of the present invention to provide a simpler assembly process.

SUMMARY OF THE EXAMPLE EMBODIMENTS

According to an example embodiment, there is provided a dielectrically loaded antenna for operation at a frequency in excess of 200 MHz comprising an electrically insulative core of a solid material having a relative dielectric constant greater than 5 and having an outer surface including oppositely directed transversely extending surface portions and a side surface portion extending between the transversely extending surface portions, the core outer surface defining an interior volume the major part of which is occupied by the solid material of the core; a three-dimensional antenna element structure including at least a pair of elongate conductive antenna elements disposed on or adjacent the side surface of the core and extending from one of the transversely extending surface portions towards the other transversely extending surface portion, and conductive surface connection elements on the said one transversely extending surface portion of the core, the connection elements being connected to the elongate antenna elements; and a matching section comprising a transversely extending laminate board secured to the said one transversely extending surface portion of the core, and, on the board, feed connections and antenna element connections; wherein the laminate board is spaced from the said one transversely extending surface portion of the core and the antenna element connections on the board are connected to the surface connection elements by a ball grid array.

The term "ball grid array" (conventionally abbreviated to "BGA") denotes an area array of solder elements, typically solder balls or "bumps" that are attached to the face of a substrate, preferably the laminate board in the present case, the substrate including conductors forming part of a network. The solder elements are arranged in a predetermined pattern so that their positions match the positions of the conductive parts of the substrate to which they are connected, as well as the positions of conductors to which the substrate is to be connected. Ball grid arrays have been used in the past to connect integrated circuits with large numbers of external connections to an underlying printed circuit board. The solder elements are generally spherical. They may be simple spheres of solder with a flux-containing outer adhesive coating in order that they adhere to the substrate prior to assembly and heating. The balls may also include heat-resistant cores which act as spacers when the solder melts.

In example embodiments of the present invention, the matching network consists of a shunt capacitance connected between the conductors of the feeder, and a series inductance coupled between one of the feeder conductors and one or more of the antenna elements. The capacitance may take the form of a lumped capacitor on a proximal surface of the laminate board, where it may also act as a spacer for setting the spacing between the laminate board and the respective surface portion of the core, or it may be embodied as parallel conductive layers of the laminate board itself. The inductance typically includes a conductive track forming part of the laminate board.

In some examples, the laminate board has a coating of solder resist with apertures in the resist at the locations of elements of the ball grid array so that, when the components of the antenna are heated during assembly, the flow of solder of the ball grid array elements is confined to the required areas.

Typically, the core of the antenna is made of a ceramic material, the conductive surface connection elements comprising metallic layer portions bonded to the surface of the ceramic material. No solder resist mask is required on the core surface where it is in registry with the laminate board.

Example embodiments of the invention are backfire antennas having a feeder housed in a passage through the core. In such examples, the ball grid array is advantageously used to connect the matching network to both the feeder and to the conductive surface connection elements on the surface of the core. The feeder may be in the form of a coaxial transmission line section housed in a passage which extends through the core between the core end surfaces. The transmission line section preferably has a distal end which is located substantially flush with a distal end surface of the core, and the laminate board preferably has generally centrally located feed connections connected by respective elements of the ball grid array to the inner and outer conductors respectively of the transmission line section. The other elements of the ball grid array are used to connect the antenna element connections of the matching network to the surface connection elements on the core end surface, these elements of the array being arranged on opposite sides of those elements of the array that interconnect the feed connections and the transmission line section. The laminate board may act as a diaphragm to accommodate differential temperature-dependent expansion of the feeder and the core in a direction perpendicular to the board, i.e. longitudinally of the feeder.

Advantageously, the surface connection elements on the core end surface to which the laminate board is secured lie in a common plane and the outer conductor of the transmission line section has at least one transversely oriented conductive tab having a distally directed surface substantially coplanar with the distally directed surfaces of the surface connection elements. At the other end of the transmission line, the feeder may be provided with at least one transversely and outwardly directed proximal conductive leaf for connecting one of the conductors of the transmission line section to a conductive layer on the other end surface of the core. Such a conductive layer may form part of a linking conductor for linking the elongate antenna elements at opposite ends thereof to the ends coupled to the matching network. Although the laminate board itself may accommodate longitudinal differential temperature-dependent expansion of the feeder and core such differential expansion may additionally be accommodated by the longitudinal compliance of the proximal conductive leaf or leaves on the feeder, i.e. compliance in the longitudinal direction of the feeder. Depending on the anticipated application of the antenna, this interconnection between the transmission line section and the conductive layer on the other end surface of the core may take the form of a flange or a conductive tab or tabs.

It will be understood, therefore, that in example embodiments, the ball grid array is used to connect a substrate to two different components, each extending longitudinally, i.e. in a direction perpendicular to the substrate, these two components being interconnected at a distance from their connection to the substrate and having differing thermal characteristics, i.e. thermal coefficients of expansion. In this way, mechanical strains on solder joints are dissipated.

Example antennas have a central axis of symmetry, the core preferably being cylindrical and the antenna elements constituting conductive helices formed as conductive tracks on the cylindrical side surface of the core. Particularly in the case of an antenna having two or more pairs of helical antenna elements, the conductive surface connection elements on the end surface of the core to which the laminate board is secured, may each have a significant angular extent, subtending at least 45°, typically at least 60° at the antenna central axis. The antenna element connections of the matching section may have a similar angular extent with each such antenna element connection and surface connection element in registry therewith being interconnected by a plurality of spaced-apart elements of the ball grid array. In this way, distributed connections may be effected between the matching section and the antenna elements, as mentioned above.

The ability of the laminate board to act in the manner of a diaphragm to accommodate differential longitudinal expansion of the feeder and the core is aided if the antenna element connections are laterally spaced from the feed connections on the laminate board.

In effect, the ball grid array may provide three groups of solder elements: a first generally axially located group interconnecting the feeder and the laminate board, a second group located laterally with respect to the first group and on one side thereof, interconnecting one group of antenna elements to the laminate board, and a third group of solder elements interconnecting another group of antenna elements to the laminate board, this third group also being laterally spaced with respect to the first group of solder elements, on the opposite side thereof with respect to the second group.

The spacing between the laminate board and the surface of the core bearing the laminate board may be defined by a plurality of spacers, preferably bonded to the surface of the laminate board. At least one of the spacers may be a lumped capacitor forming part of the network of the matching section.

The ball grid array has been used as a high interconnection density system. However, with regard to the number of topographical interconnections made by the ball grid array disclosed herein, normally there is a maximum of eight interconnections, and preferably four, within an area of at least 10 square millimetres. It follows that the topographical interconnection density is typically less than 0.8 per square millimetre and, in most embodiments of the present invention, less than 0.4 per square millimetre. The term "topographical interconnection" here means an interconnection between components of the antenna at a respective circuit node. As mentioned above, in example embodiments of the invention, one or more of such interconnections is made by a plurality of ball grid elements in order spatially to distribute the respective electrical interconnection. For instance, each of the interconnections between antenna element connections on the laminate board and the conductive surface connection elements on the said one end surface of the core may be made by a group of spaced-apart ball grid elements, the group typically subtending an angle of at least 45 degrees at a central axis of the antenna.

According to other embodiments of the invention, there is provided a method of manufacturing a dielectrically loaded antenna for operation at a frequency in excess of 200 MHz, the antenna comprising an electrically insulative core of a solid material with a passage therethrough defining a feed axis, an antenna element structure on the core and including conductive surface connection elements formed as conductive layer portions located on an outer surface portion of the core near one end of the passage, an elongate feeder housed in the passage, and a matching section including a laminate board, wherein the method includes:

(i) inserting the feeder in the passage;

(ii) providing the matching section as the combination of the laminate board and a ball grid array;

(iii) positioning the laminate board so as to overlie the said outer surface portion of the core in a predetermined orientation and at a predetermined spacing therefrom, the ball grid array being positioned between the laminate board and the said outer surface portion; and (iv) forming electrical connections between the laminate board, the conductive layer portions on the core and the feeder, which forming step includes heating the assembly resulting from step (iii) to a temperature sufficient to melt the elements of the ball grid array.

In example embodiments, the ball grid array is initially pre-affixed to a connection face of the laminate board rather than to the antenna core, step (iii) including juxtaposing the laminate board, with the ball grid array on its connection face, over the outer surface portion of the core in the required orientation. This step can be carried out by machine.

The ball grid array may be so arranged that at the end of step (iii) above, it has elements engaging the feeder and elements engaging the conductive layer portions on the core, the heating step, step (iv), including forming electrical connections between both the laminate board and the feeder and between the laminate board and the conductive layer portions. Again, the heating step, which may include transporting the antenna into an oven, can be carried out entirely by machine.

The manufacturing process may be initiated with inserting of the feeder from the other end (referred to hereinabove as the "proximal" end of the passage). This may be carried out automatically, potentially on the same machine as that which brings the laminate board into juxtaposition with the core, the core being inverted between steps (i) and (iii).

The heating of the assembly in step (iv) may additionally result in a soldered electrical connection being formed between the feeder and a conductive layer portion on the core adjacent the other (proximal) end of the passage.

Example embodiments of the present invention will now be described with reference to the drawings.

DETAILED DESCRIPTION OF EXAMPLE EMBODIMENTS OF THE INVENTION

Referring to FIGS. 1 to 4, an antenna in accordance with an example embodiment of the invention has an antenna element structure with four axially coextensive helical tracks 10A, 10B, 10C, 10D plated or otherwise metallised on the cylindrical outer surface of a cylindrical ceramic core 12.

Figure 3:
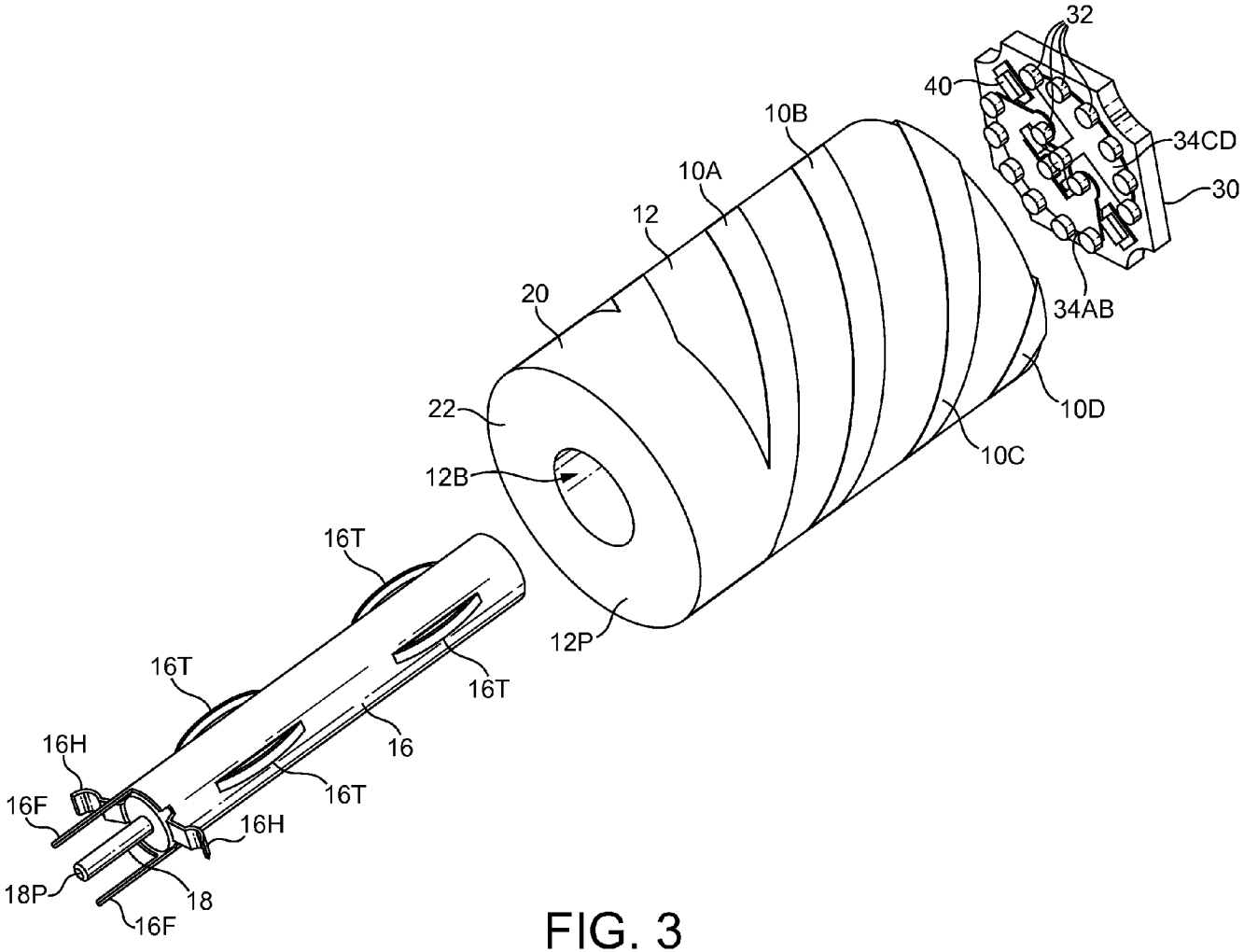
FIG. 3 is an exploded perspective view of the antenna, showing a plated antenna core, a coaxial feeder, and a matching section, in accordance with an example embodiment of the invention.

The core has an axial passage in the form of a bore 12B extending through the core 12 from a distal end surface 12D to a proximal end surface 12P. Both of these surfaces are planar faces extending transversely and perpendicularly with respect to the central axis of the core. They are oppositely directed, in that one is directed distally and the other proximally in this embodiment of the invention. Housed within the bore 12B is a feeder in the form of a coaxial transmission line section having a conductive tubular outer shield 16 and an elongate inner conductor 18 which is insulated from the shield by an air gap. As shown in FIG. 3, the shield 16 has outwardly projecting and integrally formed spring tangs 16T or spacers which space the shield from the walls of the bore 12B so that a second tubular air gap exists between the shield 16 and the wall of the bore 12B.

Figure 1:
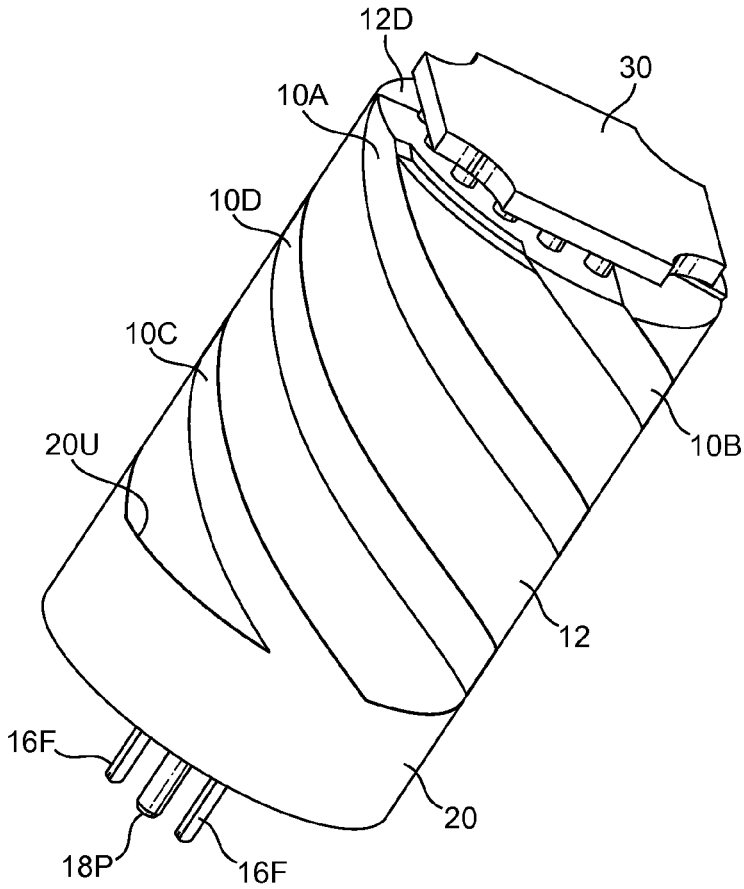
FIG. 1 is a perspective view of a quadrifilar helical antenna in accordance with an example embodiment of the invention, viewed from above and the side.
Figure 2:
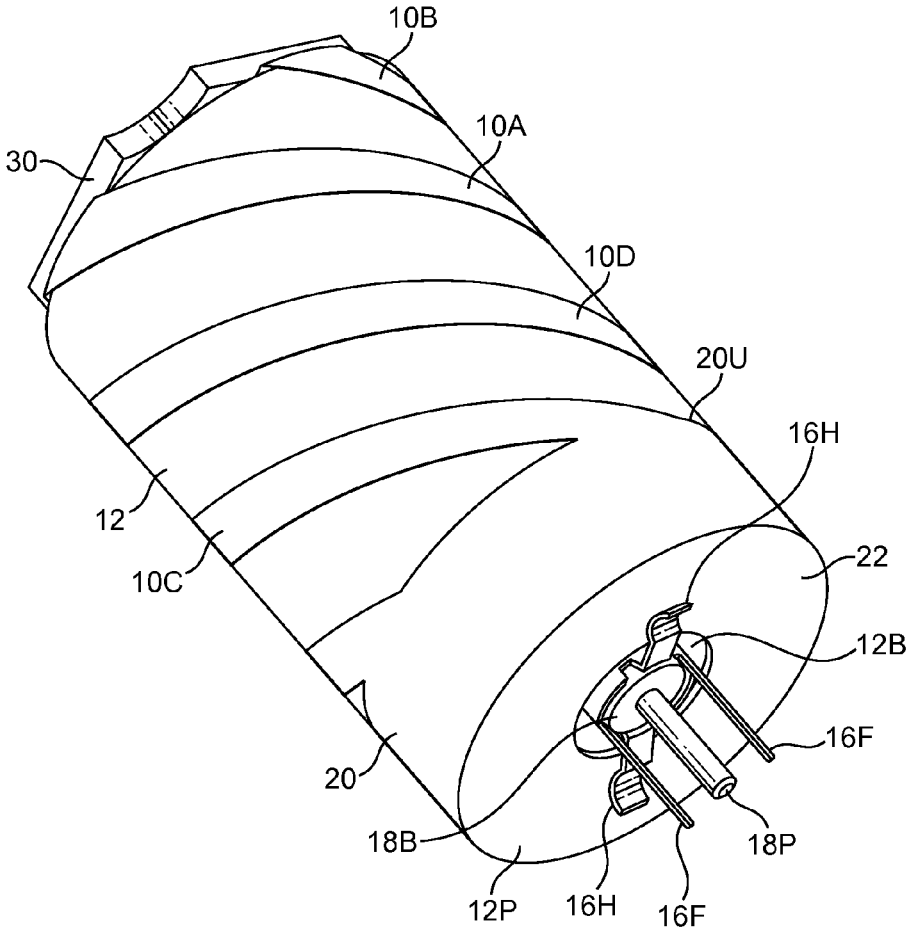
FIG. 2 is a perspective view of the antenna of FIG. 1, viewed from below and the side, in accordance with an example embodiment of the invention.

At the lower, proximal end of the feeder, the inner conductor 18 is centrally located within the shield 16 by an insulative bush 18B (FIG. 2). Another bush 18C (FIG. 4) performs the same function at the distal end.

Figure 4:
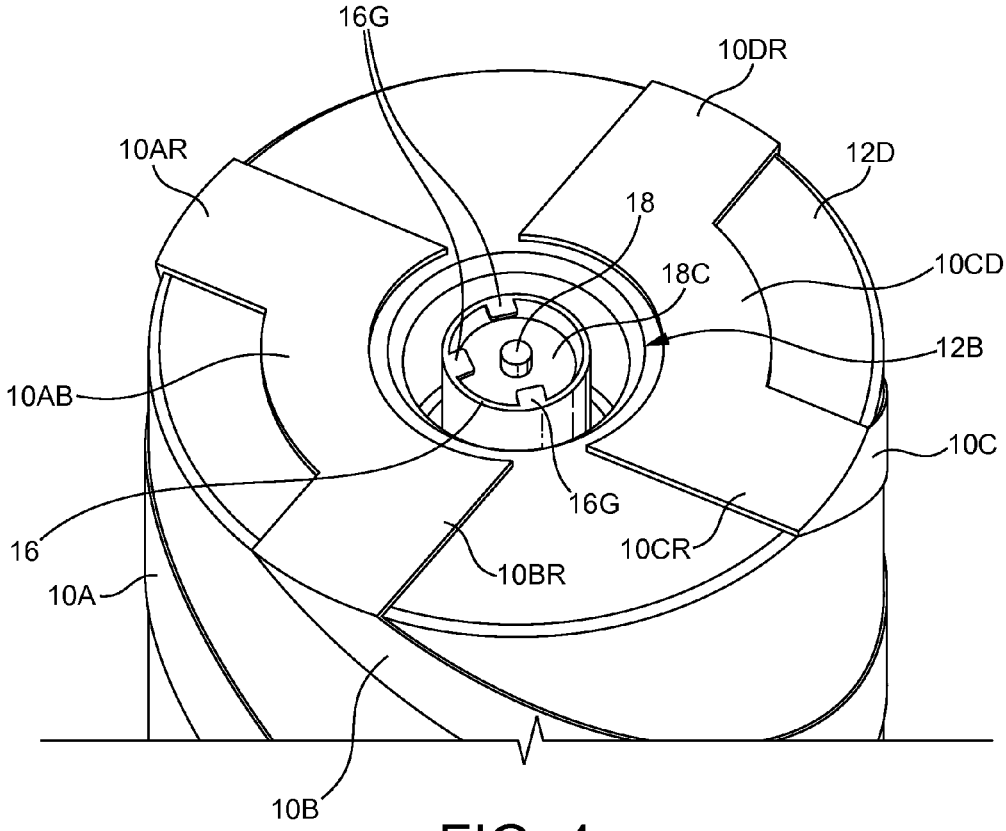
FIG. 4 is a perspective view of an upper (distal) portion of the antenna with the matching section removed, showing a distal end portion of the feeder, and conductors on a distal outer surface portion of the core, in accordance with an example embodiment of the invention.

The combination of the shield 16, inner conductor 18 and the insulative layer therebetween constitutes a feeder of predetermined characteristic impedance, here 50 ohms, passing through the antenna core 12 for coupling distal ends of the antenna elements 10A to 10D to radio frequency (RF) circuitry of equipment to which the antenna is to be connected. As shown in FIG. 4, the couplings between the antenna elements 10A to 10D and the feeder are made via conductive surface connection elements associated with the helical tracks 10A to 10D, these surface connection elements being formed as radial tracks 10AR, 10BR, 10CR, 10DR plated on the distal end surface 12D of the core 12. Each surface connection element extends from a distal end of the respective helical track to a location adjacent the end of the bore 12B. The inner conductor 18 has a proximal portion 18P which projects as a pin from the proximal surface 12P of the core 12 for connection to the equipment circuitry. Similarly, integral lugs 16F on the proximal end of the shield 16 project beyond the core proximal surface 12P for making a connection with the equipment circuitry ground.

The proximal ends of the antenna elements 10A to 10D are connected to a common virtual ground conductor in the form of a plated sleeve 20 surrounding a proximal end portion of the core 12. This sleeve 20 is, in turn, connected to the shield 16 of the feed structure in a manner to be described below.

The four helical antenna elements 10A to 10D are of different lengths, two of the elements 10B, 10D being longer than the other two 10A, 10C as a result of the rim 20U of the sleeve 20 being of varying distance from the proximal end surface 12P of the core. Where antenna elements 10A and 10C are connected to the sleeve 20, the rim 20U is a little further from proximal surface 12P than where the antenna elements 10B and 10D are connected to the sleeve 20.

The proximal end surface 12P of the core is plated, the conductor 22 so formed being connected at that proximal end surface 12P to the exposed proximal end portion of the shield conductor 16 as described below. The conductive sleeve 20, the plated layer 22 and the outer shield 16 of the feed structure together form a quarter wave balun which provides common-mode isolation of the antenna element structure from the equipment to which the antenna is connected when installed. The metallised conductor elements formed by the antenna elements and other metallised layers on the core define an interior volume the major part of which is occupied by the material of the core.

The differing lengths of the antenna elements 10A to 10D result in a phase difference between currents in the longer elements 10B, 10D and those in the shorter elements 10A, 10C respectively when the antenna operates in a mode of resonance in which the antenna is sensitive to circularly polarised signals. In this mode, currents flow around the rim 20U between, on the one hand, the elements 10C and 10D connected to the inner feed conductor 18 and on the other hand, the elements 10A, 10B connected to the shield 16, the sleeve 20 and proximal layer 22 acting as a trap preventing the flow of currents from the antenna elements 10A to 10D to the shield 16 at the proximal end surface 12P of the core. It will be noted that the helical tracks 10A-10D are interconnected in pairs on the distal end surface 12D of the core by part-annular tracks 10AB and 10CD between the inner ends of the respective radial tracks 10AR, 10BR and 10CR, 10DR so that each pair of helical tracks has one long track 10B, 10D and one short track 10A, 10C. These part-annular tracks each subtend an angle of more than 90° at the central axis. Operation of quadrifilar dielectrically loaded antennas having a balun sleeve is described in more detail in British Patent Applications Nos. GB2292638A and GB2310543A; the entirety of each application is incorporated by reference herein.

The feed structure performs functions other than simply conveying signals to or from the antenna element structure. Firstly, as described above, the shield conductor 16 acts in combination with the sleeve 20 to provide common-mode isolation at the point of connection of the feed structure to the antenna element structure. The length of the shield conductor between (a) its connection with the plated layer 22 on the proximal end surface 12P of the core and (b) its connection to the antenna element connection portions 10AR, 10BR, together with the dimensions of the bore 12B and the dielectric constant of the material filling the space between the shield 16 and the wall of the bore, are such that the electrical length of the shield 16 on its outer surface is, at least approximately, a quarter wavelength at the frequency of the required mode of resonance of the antenna, so that the combination of the conductive sleeve 20, the plated layer 22 and the shield 16 promotes balanced currents at the connection of the feed structure to the antenna element structure.

There is an air gap surrounding the shield 16 of the feed structure. This air sleeve, of lower dielectric constant than the dielectric constant of the core 12, diminishes the effect of the core 12 on the electrical length of the shield 16 and, therefore, on any longitudinal resonance associated with the outside of the shield 16. Since the mode of resonance associated with the required operating frequency is characterised by voltage dipoles extending diametrically, i.e. transversely of the cylindrical core axis, the effect of the low dielectric constant sleeve on the required mode of resonance is relatively small due to the sleeve thickness being, at least in the preferred embodiment, considerably less than that of the core. It is, therefore, possible to cause the linear mode of resonance associated with the shield 16 to be de-coupled from the wanted mode of resonance.

The antenna has a main resonant frequency of 500 MHz or greater, the resonant frequency being determined by the effective electrical lengths of the antenna elements and, to a lesser degree, by their width. The lengths of the elements, for a given frequency of resonance, are also dependent on the relative dielectric constant of the core material, the dimensions of the antenna being substantially reduced with respect to an air-cored quadrifilar antenna.

One preferred material of the antenna core 12 is a barium-samarium-titanate-based material. This material has a relative dielectric constant of about 80 and is noted also for its dimensional and electrical stability with varying temperature. Dielectric loss is low. The core may be produced by extrusion or by pressing and sintering.

The antenna is especially suitable for L-band GPS reception at 1575 MHz. In this case, the core 12 has a diameter of about 7.5 mm and the longitudinally extending antenna elements 10A-10D have an average longitudinal extent (i.e. parallel to the central axis) of about 9 mm. At 1575 MHz, the length of the conductive sleeve 20 is typically in the region of 2.5 mm. Precise dimensions of the antenna elements 10A to 10D can be determined in the design stage on a trial and error basis by undertaking eigenvalue delay measurements until the required phase difference is obtained.

Further details of the feed structure will now be described. The feed structure comprises the combination of the feeder, which is a coaxial 50 ohm transmission line section 16, 18 and a matching section including a planar laminate board 30 connected to a distal end of the line. The laminate board or printed circuit board (PCB) 30 overlies the distal end surface 12D of the core 12, parallel thereto at a predetermined spacing and in a predetermined orientation. The largest dimension of the PCB 30 is smaller than the diameter of the core 12 so that the PCB 30 is fully within the periphery of the distal end surface 12D of the core 12.

In this embodiment, the PCB 30 is in the form of an approximately square tile centrally located on the distal surface 12D of the core. Its transverse extent is such that it overlies the inner ends of the radial tracks 10AR, 10BR, 10CR and 10DR and their respective arcuate interconnections 10AB, 10CD. The PCB 30 is a laminate having an insulative glass fibre composite and a single conductive layer on its underside, i.e. the face that faces the distal end surface 12D of the core. The laminate board conductive layer provides feed connections and antenna element connections for coupling the conductors 16, 18 of the transmission line section to the antenna elements 10A-10B via the conductive surface connection elements 10AR-10DR, 10AB, 10CD on the core distal end surface 12D. The laminate board conductive layer also constitutes, in conjunction with a surface-mounted capacitor, an impedance matching network for matching the impedance presented by the antenna element structure to the characteristic impedance (50 ohms) of the transmission line section 16, 18. The feed connections and antenna element connections formed by the conductive layer on the underside of the PCB 30 are connected to the conductors 16, 18 of the transmission line section and to the arcuate conductive surface connection elements 10AB, 10CD on the core distal end surface 12D by a ball grid array constituted by an area array of solder elements 32, as seen in the exploded view of FIG. 3. In the preferred antenna, the transmission line section conductors 16, 18 terminate at their distal ends in distal end surfaces which are flush with the exposed surfaces of the conductive surface connection elements 10AR-10DR, 10AB, 10CD, as shown in FIG. 4. Thus, the inner conductor 18 terminates in an end surface perpendicular to the axis, whilst the shield 16 is formed with transversely directed tabs 16G which take the form of inwardly directed tongues providing coplanar distal surfaces. Each of these distally directed surfaces of the transmission lines 16, 18 receives a respective element of the ball grid array. As for the antenna element connections provided by the conductive layer on the underside of the PCB 30, these are shaped to match the arcuate surface connection elements 10AB, 10CD on the core distal end surface, the interconnections between the latter and the antenna element connections being effected, in each instance, by a number of spaced-apart ball grid array elements 32, forming a spatially distributed interconnection, as will be described in more detail below.

Referring to FIGS. 2 and 3, the shield 16 of the transmission line section 16, 18 is connected at its proximal end to the proximal end surface plating 22 on the core by a pair of laterally outwardly extending leaves in the form of resilient tabs 16H which are of sufficient length to span the annular air gap between the shield conductor 16 and the wall of the bore 12B and to allow a soldered connection to the plating 22. It will be understood that the configuration of these proximal connection tabs 16H and the length of the transmission line section are such as to yield the flush relationship of the distal end surfaces of the transmission line conductors 16, 18 at the distal end of the passage 12B. During assembly of the antenna, the PCB 30 is presented to the distal end face of the core with the solder elements 32 of the ball grid array already attached (by an adhesive coating) to the underside of the PCB 30 in their required positions.

Figure 5:
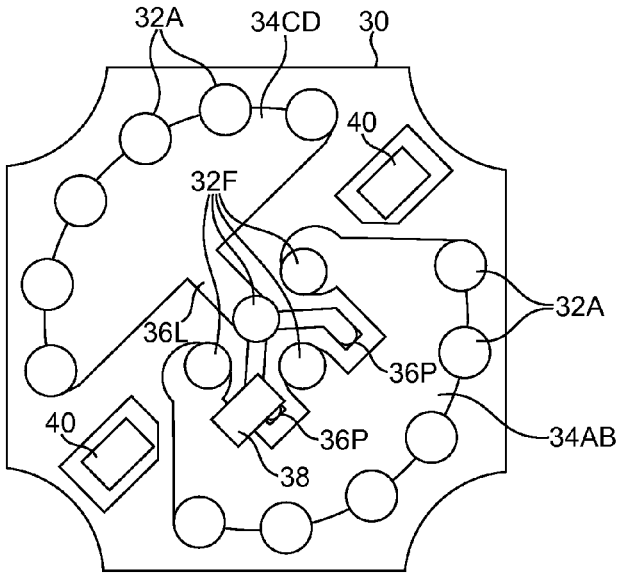
FIG. 5 is an underside view of the matching section, and a ball grid array, in accordance with an example embodiment of the invention.

Referring to FIG. 5, in the preferred embodiment of the invention, four solder elements 32F are attached to the feed connections and six solder elements 32A, 32B are attached to each of the antenna element connections 34AB, 34CD.

The function of the conductor pattern of the conductive layer of the PCB 30 includes not only coupling the feeder to the antenna elements, but also effecting an impedance match. Still referring to FIG. 5, a first feed connection at the center of the PCB 30 is coupled firstly by an elongate track section 36L to a segment-shaped conductive area forming a first antenna element connection 34CD which is angularly distributed, subtending an angle of about 120° at the center, to match the angular extent of the arcuate interconnection 10CD (FIG. 4) to which it is to be connected. In effect, therefore, the central feed connection on the PCB 30 is coupled to a first pair 10C, 10D of the helical antenna elements by a series inductance, as represented by the inductance L in FIG. 6.

The conductor pattern of the PCB conductive layer provides for two further connections to the central feed connection. Each of these connections terminates in a conductive pad 36P, each pad being adjacent a sector-shaped conductive area forming a second antenna element connection 34AB which, itself, has three pads close the center of the PCB for connection to the distal end of the shield 16 of the feeder. The close juxtaposition of the feed connection pads 36P and the conductive area forming the antenna element connection 34AB allows two surface-mounted chip capacitors (only one of which, capacitor 38, is shown in FIG. 5) to be used on the PCB conductive layer (i.e. on the face of the PCB 30 facing the core) to bridge the feed connection elements as a shunt capacitor, appearing as capacitor C in FIG. 6. As in the case of the segment-shaped antenna element connection area 34CD, the second sector-shaped antenna element connection area 34AB also subtends an angle of about 120° at the center of the PCB 30, matching the angular extent of the respective arcuate interconnection 10AB (FIG. 4) on the distal end surface 12D of the core so that the shield 16 of the feeder is connected directly to the other two antenna elements 10A, 10B.

Figure 7:
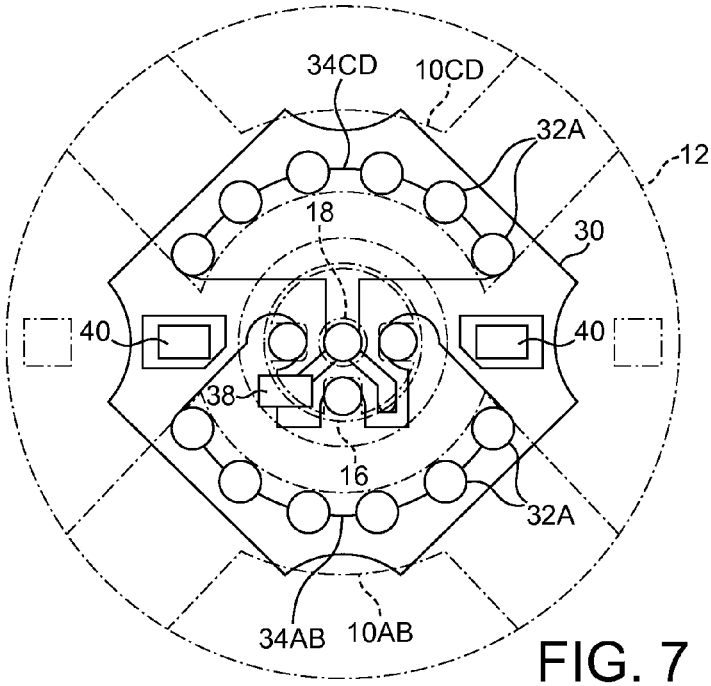
FIG. 7 is an underside view of the matching section corresponding to the view of FIG. 5, with the feeder distal end and the conductor pattern of the distal end surface of the antenna core shown superimposed in phantom, in accordance with an example embodiment of the invention.

Such connections between the PCB 30 and the conductive areas on the distal end surface 12D of the core require not only that the PCB 30 be placed centrally on the distal end surface 12D but also at a predetermined rotational orientation so that the antenna element connection areas 34AB, 34CD are in registry with the arcuate interconnections 10AB, 10CD on the distal end surface 12D, as shown in FIG. 7 which is an underside view of the PCB 30 with the distal end surface 12D conductor pattern (viewed from beneath) superimposed on the PCB 30 image. Note that FIG. 7 also indicates the interrelationship between the coaxial feeder 16, 18 and the conductive pattern on the underside of the PCB 30.

Referring again to FIG. 5, the chip capacitor 38 can be used as a spacer to set the spacing between the PCB 30 and the distal end surface 12D of the core. However, in this embodiment, spacers 40 having no other function are attached to the underside of the PCB. It will be noted from FIG. 7 that these spacers 40 abut the distal end surface 12D of the core at locations where the ceramic material of the core is exposed between conductive areas of the conductive plating on the core.

Figure 6:
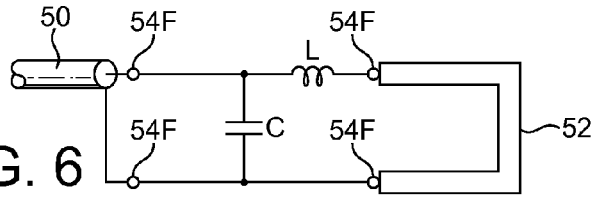
FIG. 6 is a circuit diagram of the feeder, the matching network, and an antenna element structure of the antenna, in accordance with an example embodiment of the invention.

Referring to FIG. 6, the matching network formed by the PCB 30 and capacitor 38 has a series inductance L interconnecting the inner conductor of the feeder 50 and one side of the antenna element structure 52 (shown in equivalent circuit form) and a shunt capacitance C coupled between the inner and shield conductors 16, 18 of the feeder 50 and between the two sides of the antenna element structure 52, the shield 16 being connected directly to the side of the antenna element structure 52 opposite that connected to the inductance L. The ball grid array effects four topographical interconnections, i.e. feed connections 54F between the matching network L, C and the feeder 50 and two antenna element connections 54A between the matching network L, C and the antenna element structure 52. Each such interconnection is an interconnection between components of the antenna at a single respective circuit node. Nevertheless, three of these interconnections are each formed by a plurality of ball grid solder elements. Thus, as is apparent from the description above with reference to FIGS. 5 and 7, the interconnection 54F (FIG. 6) between the shield of the feeder 50 and the capacitor is effected by three of the feed connection ball grid elements 32F (see FIG. 5), whilst each of the interconnections 54A (FIG. 6) between the matching network L, C and the antenna element structure 52 is formed by six ball grid elements 32A (also shown in FIG. 5). Here, therefore, groups of ball grid array elements are used at single respective circuit nodes to form distributed connections thereby distributing current flow between the feeder and the matching network and between the matching network and the antenna elements. This has particular relevance to minimising the radiation resistance of the antenna at its operating frequency or frequencies.

The contacts of the PCB 30 to the feeder and the contacts to the conductive areas on the core distal end surface are independent of each other in the sense that each set of contacts is formed by its respective solder elements and these solder elements are spaced apart with respect to each other.

The matching section constituted by the PCB 30 and the capacitor 38 mounted thereon requires only a single conductive layer on the PCB. Alternative laminate board constructions may be used. For instance, the PCB 30 may have multiple conductive layers, each separated by an insulative layer, as described in the above-mentioned prior Published International Application No. WO2006/136809. In such a case, the shunt capacitor is formed by the self-capacitance of neighboring conductive layers of the laminate board.

Assembly of the antenna will now be described. All of the operations described below may be performed by machine.

In example embodiments, a first assembly step comprises inserting the feeder 16, 18 (see FIG. 3) into the bore 12B of the upturned antenna core 12, i.e. from the proximal end of the core 12B, the feeder 16, 18 being pushed home until the outwardly extending proximal tabs 16H on the shield conductor 16 contact the plated proximal surface 12P of the core. The core is then inverted and the PCB 30, bearing the ball grid array, is placed on the distal end surface of the core 12D in a pick-and-place step, the PCB 30 being automatically oriented to align the antenna element connection areas 34AB, 34CD with the arcuate interconnection areas 10AB, 10CD on the core (see FIG. 7). The ball grid array elements 32 now abut the distal end surfaces of the feeder conductors 16, 18 and the exposed conductive layer portions constituted by the arcuate interconnecting tracks 10AB, 10CD on the core. Next, this assembly of core 12, feeder 16, 18, and PCB 30 is passed through an oven. This causes the solder elements 32 of the ball grid array to melt and to deform to create electrically conductive bonds when they solidify on cooling between the juxtaposed conductive areas on the PCB 30 and on the distal end surface 12D of the core, as well as the distal end surfaces of the via 16, 18. A polymer resist film selectively applied beforehand to PCB 30 underside limits spread of the solder elements on the PCB 30 when heated, surface tension of the solder bumps then preventing unwanted solder spread on the conductive areas on the core conductors. Solder paste previously applied selectively (by screen printing) to the plating 22 on the proximal end surface 12P of the core adjacent the bore 12B also melts so as to bond the tabs 16H at the proximal end of the feeder 16, 18 electrically to the proximal core plating 22 upon cooling.

Electrically, the antenna described above operates largely identically to the quadrifilar antennas described in the above-mentioned prior WO2006/136809. However, use of a ball grid array to connect the matching section PCB to the core has advantages in terms of manufacturing efficiency and in terms of the ability to withstand temperature cycling over time, including relieving physical stress in a direction perpendicular to the PCB. The solder elements 32 of the ball grid array and the lateral spacing of the connections effected by the solder elements of the array provide longitudinal compliance, the PCB acting as a flexible diaphragm to accommodate differential rates of thermal expansion and contraction in the assembly of the core and the feeder. The solder elements 32 also exhibit a degree of creep over time, helping to accommodate thermal effects. Further compliance is provided by use of resilient metallic tabs (the tabs 16H shown in FIG. 3) bridging the gap between the proximal end of the coaxial transmission line section 16, 18 and the proximal end surface 12P of the core.

Figure 8:
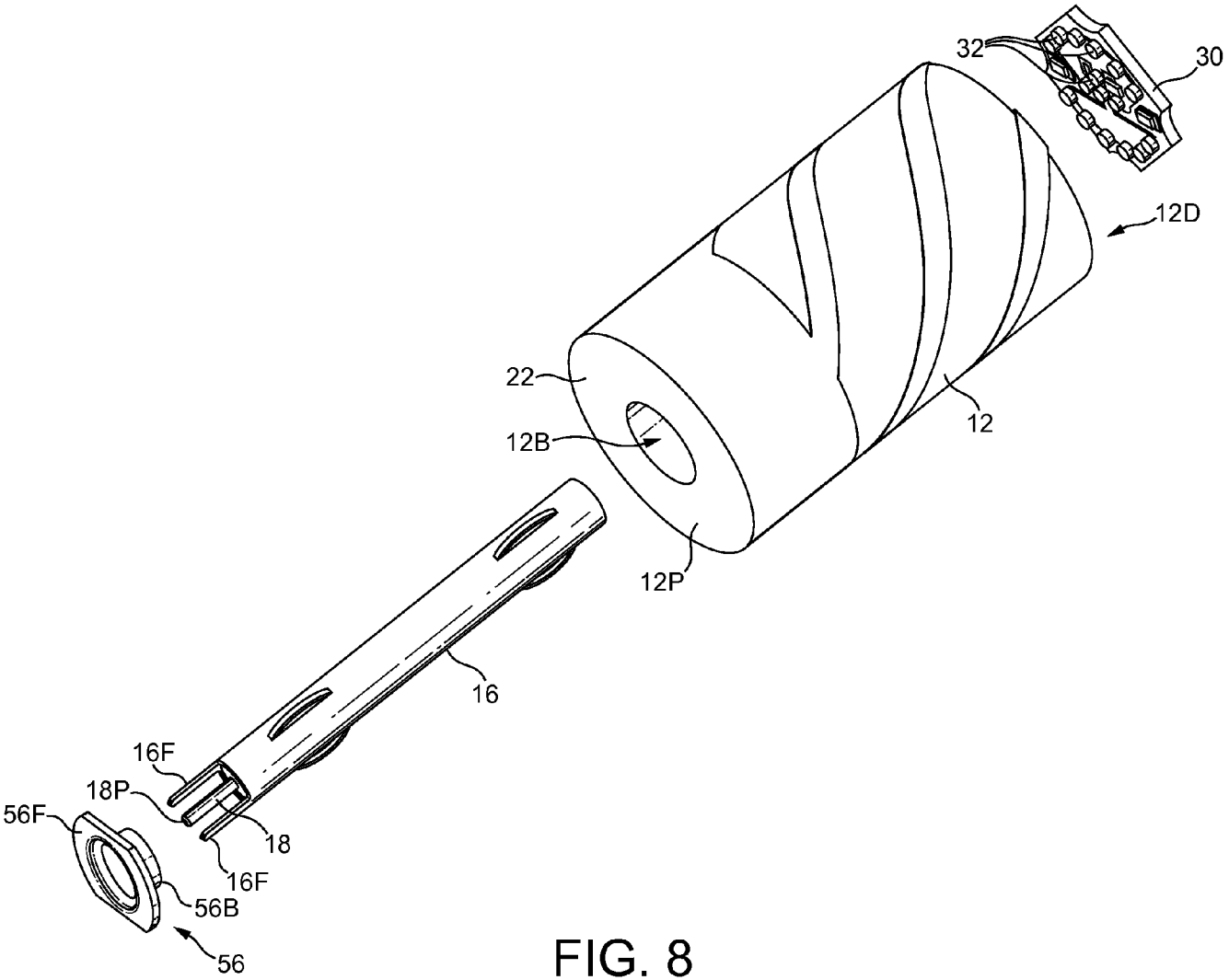
FIG. 8 is an exploded perspective view of an alternative antenna in accordance with an example embodiment of the invention.
Figure 9:
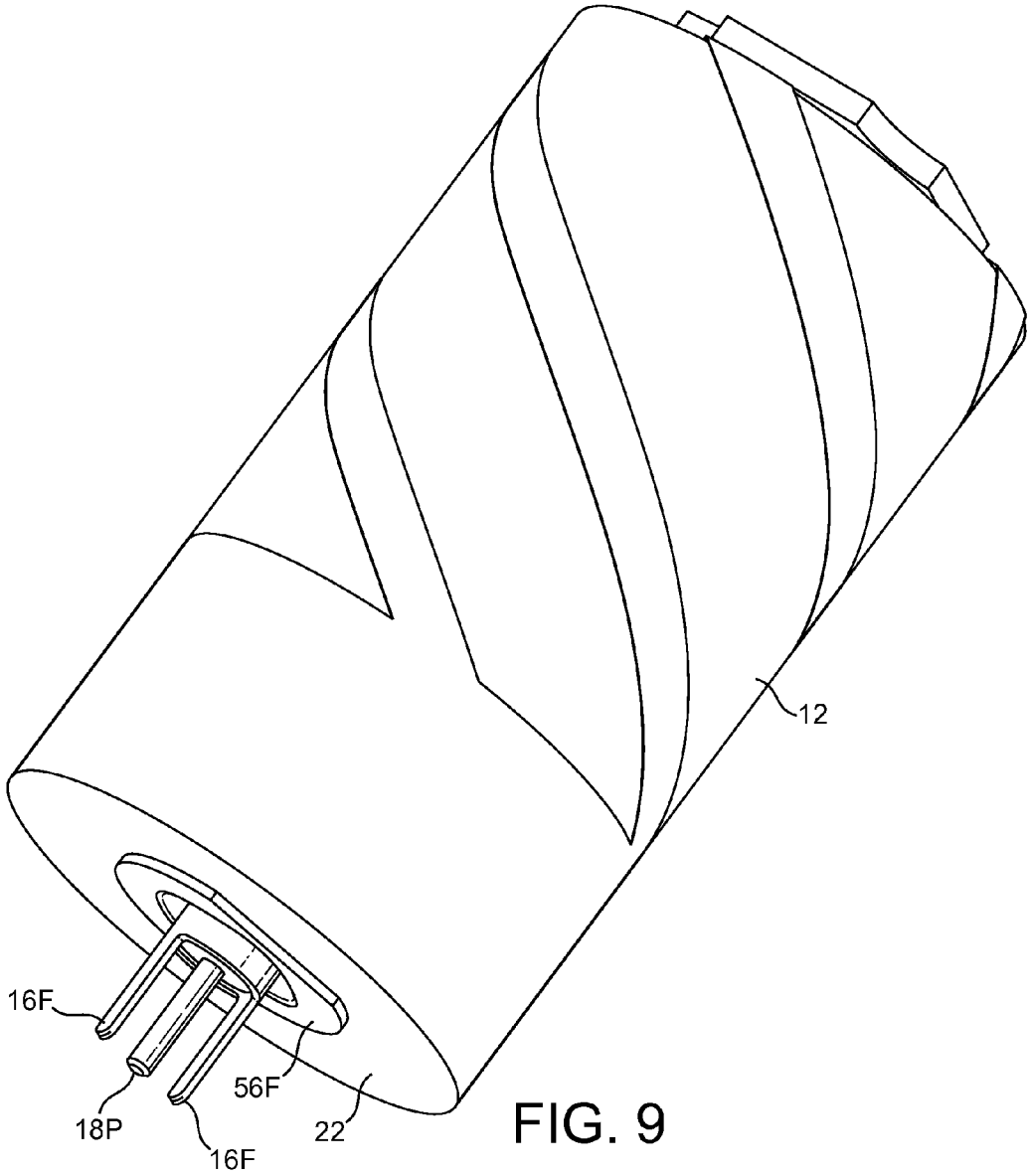
FIG. 9 is a perspective view of the alternative antenna, viewed from below and the side, in accordance with an example embodiment of the invention.

Referring to FIGS. 8 and 9, in an alternative antenna in accordance with example embodiments of the invention, the shield 16 of the transmission line section 16, 18 has a conductive proximal flange at its proximal end dimensioned to overlap the plating 22 around the periphery of the bore 12B. Accordingly, in this embodiment of the invention, the flange 56F replaces the tabs 16H of the embodiment described above with reference to FIGS. 1 to 4. In this particular embodiment, the flange 56F forms part of a bush or collar 56 having a sleeve portion 56B dimensioned to be a close fit on the tubular shield 16. The flanged bush 56 forms part of the feeder 16, 18.

Assembly of this antenna includes the following steps:

(a) Solder paste is stencil-printed to the proximal end surface 12P of the core 12 around the periphery of the bore 12B.

(b) The feeder 16, 18 is inserted into the bore 12B until its distal end is coplanar with the distal end surface 12D of the core 12.

(c) The distal edge portion of the flanged bush 56 is dipped into a controlled-depth film of solder paste to transfer solder paste to that part of the bush.

(d) The bush 56 is placed over the shield 56 of the feeder and pushed down until its flange or brim 56F abuts the solder paste layer printed on the proximal end surface 12P of the core 12. Since the inside diameter of the bush 56 is a close fit on the shield 16, the solder paste transferred by the dipping step above bridges the bush 56 and the shield 16.

(e) The core 12 is inverted and the PCB 30 is positioned on the distal end surface 12D of the core using a tacky flux to hold it in place.

(f) The assembly is heated in an oven to melt the solder and to form joints between the bush 56 and the shield 16, and between the bush 56 and the plating 22 on the proximal end surface 12P of the core. At the same time, the solder elements 32 of the ball grid array melt to form joints between the PCB 30, the feeder 16, 18 and the conductive surface connection elements on the distal end surface 12D of the core.

This alternative antenna in accordance with example embodiments of the invention has improved axial shock performance. Impact forces on the pins of the feeder 16F, 18P of the feeder are transferred to the bush 56 and thence to the core 12, thereby protecting the solder joints of the ball grid array as well as the bonds between (a) the PCB conductors and the core distal end surface connection elements and (b) their respective substrates.

What is claimed is:

1. A dielectrically loaded antenna for operation at a frequency in excess of 200 MHz comprising:

an electrically insulative core of a solid material having a relative dielectric constant greater than 5 and having an outer surface including oppositely directed transversely extending end surface portions and a side surface portion extending between the transversely extending surface portions, the core outer surface defining an interior volume the major part of which is occupied by the solid material of the core;

a three-dimensional antenna element structure including at least a pair of elongate conductive antenna elements disposed on or adjacent the side surface of the core and extending from one of the transversely extending surface portions towards the other transversely extending surface portion, and conductive surface connection elements on said one transversely extending surface portion of the core, the connection elements being connected to the elongate antenna elements;

a feeder: and a matching section comprising a transversely extending laminate board secured to said one transversely extending surface portion of the core, and, on the board, feed connections and antenna element connections;

wherein the laminate board is spaced from said one transversely extending surface portion of the core and the feed connections and the antenna. element connections on the board are connected to the feeder and to the surface connection elements on the transversely extending surface portion by a ball grid array.

2. An antenna according, to claim 1, wherein the transversely extending surface portions of the core are, respectively, distal and proximal end surfaces and wherein the solid material of the core is a ceramic material.

3. An antenna according to claim 2, wherein the feeder is in the form of a coaxial transmission line section housed in a passage extending through the core between the core end surfaces, wherein the transmission line section has a distal end located substantially flush with the distal end surface of the core, and wherein the laminate board has generally centrally located feed connections connected by respective elements of the ball grid array to inner and outer conductors respectively of the transmission line section, the antenna element connections being connected to the surface connection elements on the distal core end surface by elements of the ball grid array on opposite sides of the elements of the array interconnecting the feed connections and the transmission line section.

4. An antenna according to claim 3, wherein the surface connection elements on the distal core end surface he in a common plane, and wherein the outer conductor of the transmission line has at least one transversely directed conductive tab having a distal surface that is substantially co-planar with the distal surface of the surface connection elements.

5. An antenna according to claim 1, wherein the feeder is in the form of a transmission line section housed in a passage extending through the core between said transversely extending surface portions of the core, wherein the feed connections of the matching section are connected to conductors of the transmission line section at one end of the latter by respective elements of the ball grid array, and wherein the feeder has at least one transversely and outwardly directed conductive leaf for connecting one of the conductors of the transmission line to a conductive layer on said other transversely extending surface portion of the core.

6. An antenna according to claim 1, wherein the feeder is housed in a passage through the core, wherein said elongate antenna elements are linked at or adjacent said other transversely extending surface portion of the core by a linking conductor at least pan of which constitutes a conductor layer on the core adjacent the feeder, and wherein a conductor of the feeder is electrically connected to said linking conductor part by a compliant connection for accommodating differential temperature-dependent expansion of the feeder and the core longitudinally of the feeder.

7. An antenna according to claim 1, having a central axis, wherein:

the connection elements on said one transversely extending surface portion of the core respectively subtend an angle of at least 60 degrees at the axis;

the antenna element connections of the matching section comprise conductors in registry with said connection elements, which conductors are on a face of the laminate board that faces the core and also respectively subtend an angle of at least 60 degrees at the axis; and the connection effected by the ball grid array between each such antenna element connection and the respective said connection element on said one transversely extending surface portion is made by a plurality of spaced apart elements of the ball grid array.

8. An antenna according to claim 1, wherein the antenna element connections are laterally spaced from the feed connections on the laminate board.

9. An antenna according to claim 1, including spacers of predetermined depth between the laminate board and said one transversely extending surface portion of the core.

10. An antenna according to claim 9, wherein at least one of the spacers is a capacitor forming part of the network of the matching section.

11. A method of manufacturing a dielectrically loaded antenna for operation at a frequency in excess of 200 MHz, the antenna comprising an electrically insulative core of a solid material with a passage therethrough defining a feed axis, an antenna element structure on the core and including conductive surface connection elements formed as conductive layer portions located on an outer surface portion of the core near one end of the passage, an elongate feeder housed in the passage, and a matching section including a laminate board, wherein the method comprises:

inserting the feeder in the passage;

providing the matching section as the combination of the laminate board and a ball grid array;

positioning the laminate board so as to overlie said outer surface portion of the core in a predetermined orientation and at a predetermined spacing therefrom, the ball grid array being positioned between the laminate board and said outer surface portion and between the laminate board and the feeder; and forming electrical connections between the laminate board, and the conductive layer portions on the core and between the laminate board and the feeder by heating the assembly resulting from the positioning step to a temperature sufficient to melt the elements of the ball grid array.

12. A method according to claim 11, wherein:

the ball grid array is provided pre-affixed to a connection face of the laminate board; and the positioning step includes juxtaposing the laminate board over said core outer surface portion with the connection surface of the board facing said outer surface portion.

13. A method according to claim 11, wherein:

the inserting step includes inserting the feeder from the other end of the passage; and the heating of the assembly in the founing step additionally results in a solder connection beimg formed between the feeder and a conductive layer portion on the core adjacent said other end of the passage.

* * * * *